US007316297B2

(12) United States Patent
Wang

(10) Patent No.: US 7,316,297 B2
(45) Date of Patent: Jan. 8, 2008

(54) ELEVATOR ESCAPE DEVICE

(76) Inventor: Chiu Nan Wang, No. 50 Alley 97, Lane 354, San Her Rd., Feng Yuan, Taichung Hsien (TW)

( * ) Notice: Subject to any disclaimer, the term of this patent is extended or adjusted under 35 U.S.C. 154(b) by 418 days.

(21) Appl. No.: 11/139,713

(22) Filed: May 27, 2005

(65) Prior Publication Data

US 2006/0266588 A1 Nov. 30, 2006

(51) Int. Cl.
*B66B 13/02* (2006.01)

(52) U.S. Cl. ..... 187/313; 187/290; 187/298

(58) Field of Classification Search ..... 187/250, 187/254, 288, 290, 298, 391–396, 263, 313, 187/314, 414

See application file for complete search history.

(56) References Cited

U.S. PATENT DOCUMENTS 6,564,907 B1 * 5/2003 Sasaki ..... 187/373
7,025,179 B2 * 4/2006 Shih ..... 187/313
7,032,714 B2 * 4/2006 Wang ..... 187/311
2003/0015377 A1 * 1/2003 Wang ..... 187/290
2006/0137941 A1 * 6/2006 Andrejak et al. ..... 187/293
2006/0201752 A1 * 9/2006 Helstrom ..... 187/313

* cited by examiner

*Primary Examiner*—Jonathan Salata

(57) ABSTRACT

Provided is an elevator escape device. In response to a stop of the elevator due to power outage, a trapped person may press a switch to activate a backup generator, and either a backup electromagnetic contact is enabled if the backup generator functions normally or the person manipulates a handle to activate a slow movement assembly if the backup generator malfunctions. Thereafter, the brake is disabled by contacting a first detent a return assembly operates to return a slow movement assembly to its nonoperating position via a control assembly wherein electromagnetic contacts are short-circuited sequentially by contacting corresponding electromagnetic contacts, the car slowly arrives at a nearest correct floor, and the trapped person may to open a door to escape.

6 Claims, 8 Drawing Sheets

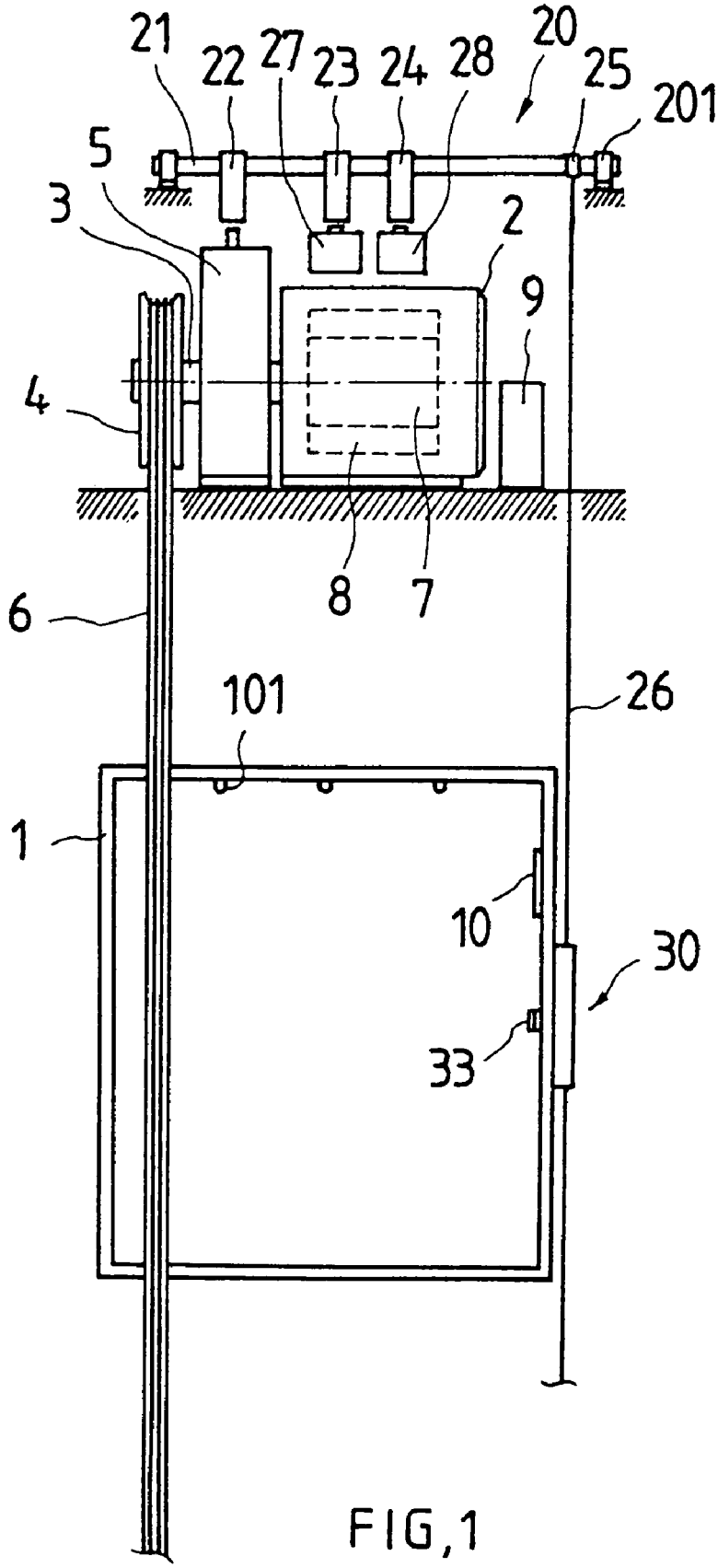
FIG,1

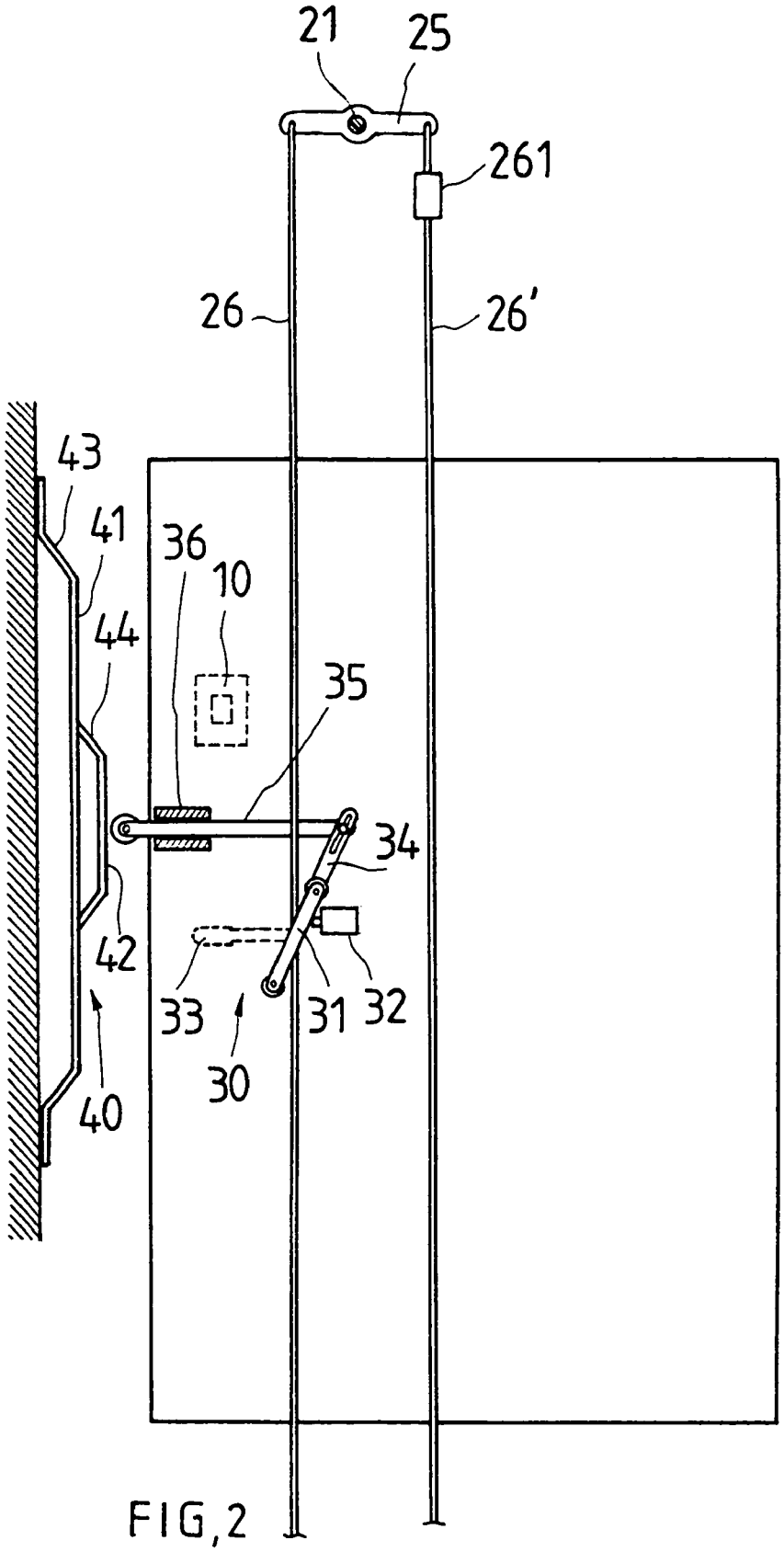
FIG,2

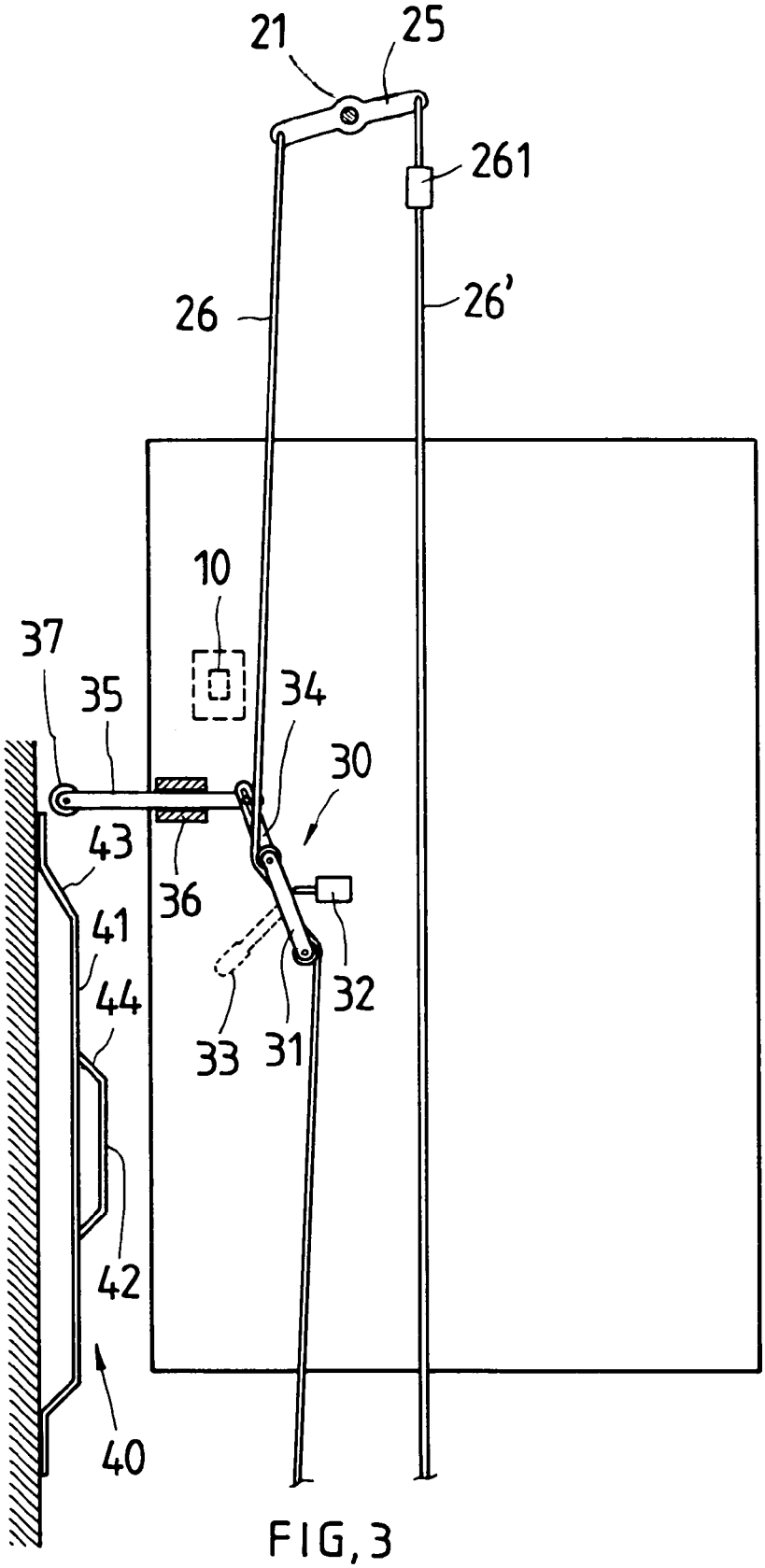
FIG, 3

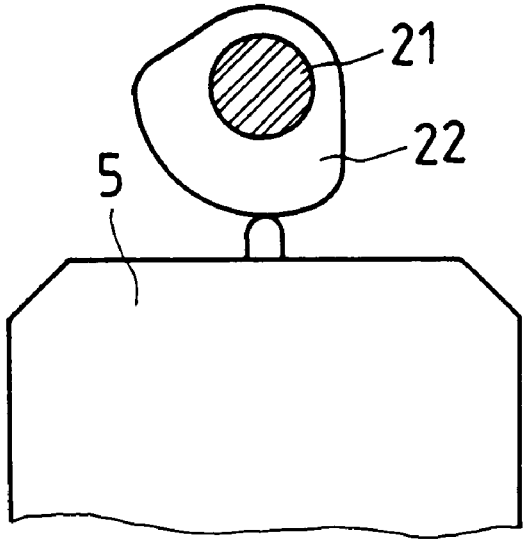
(A)
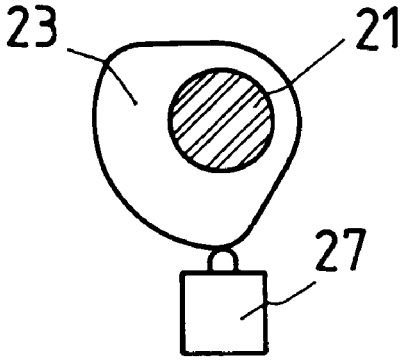
(B)
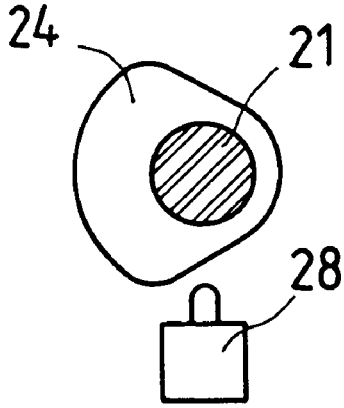
(C)
FIG,4

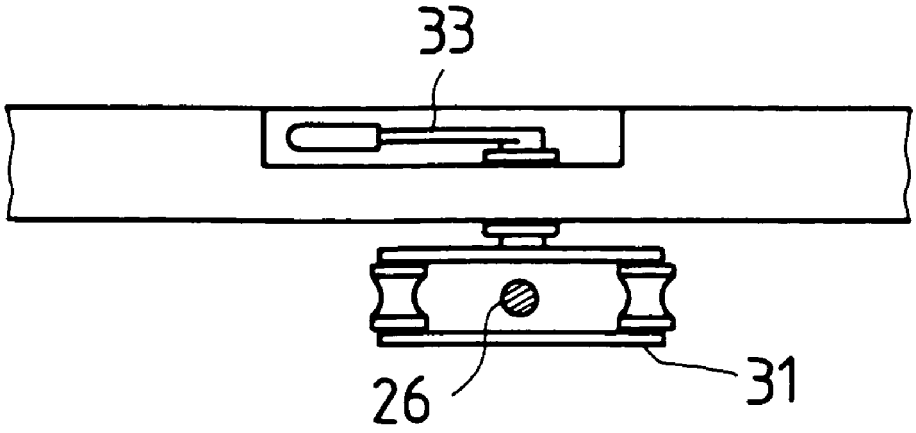
FIG,5
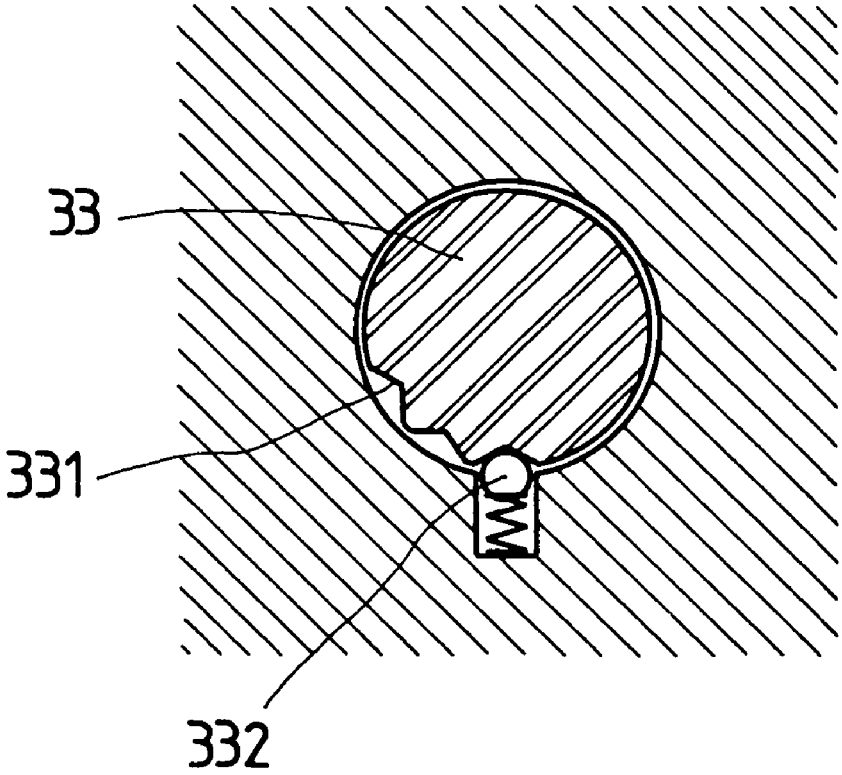
FIG,6

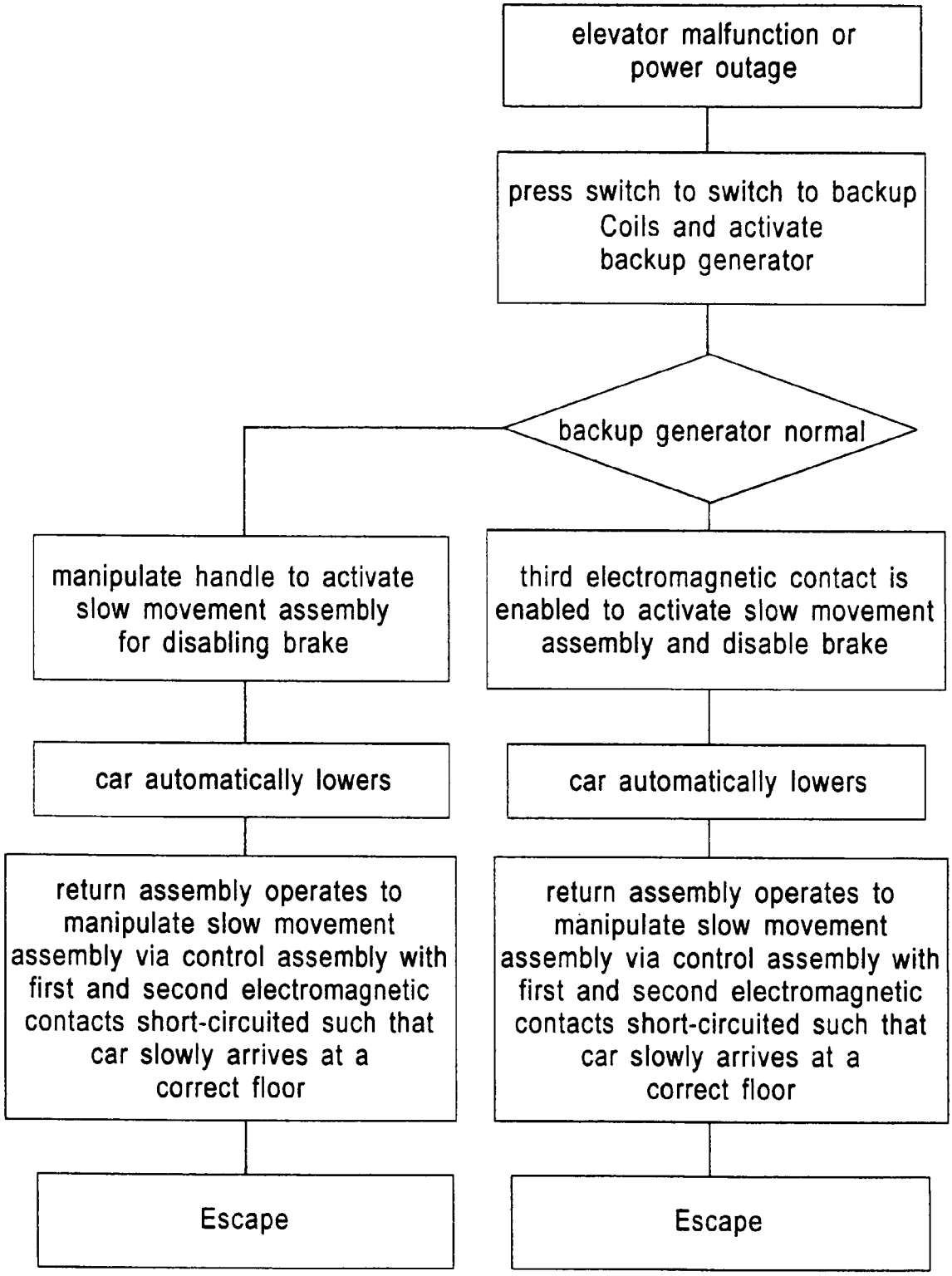
FIG,7

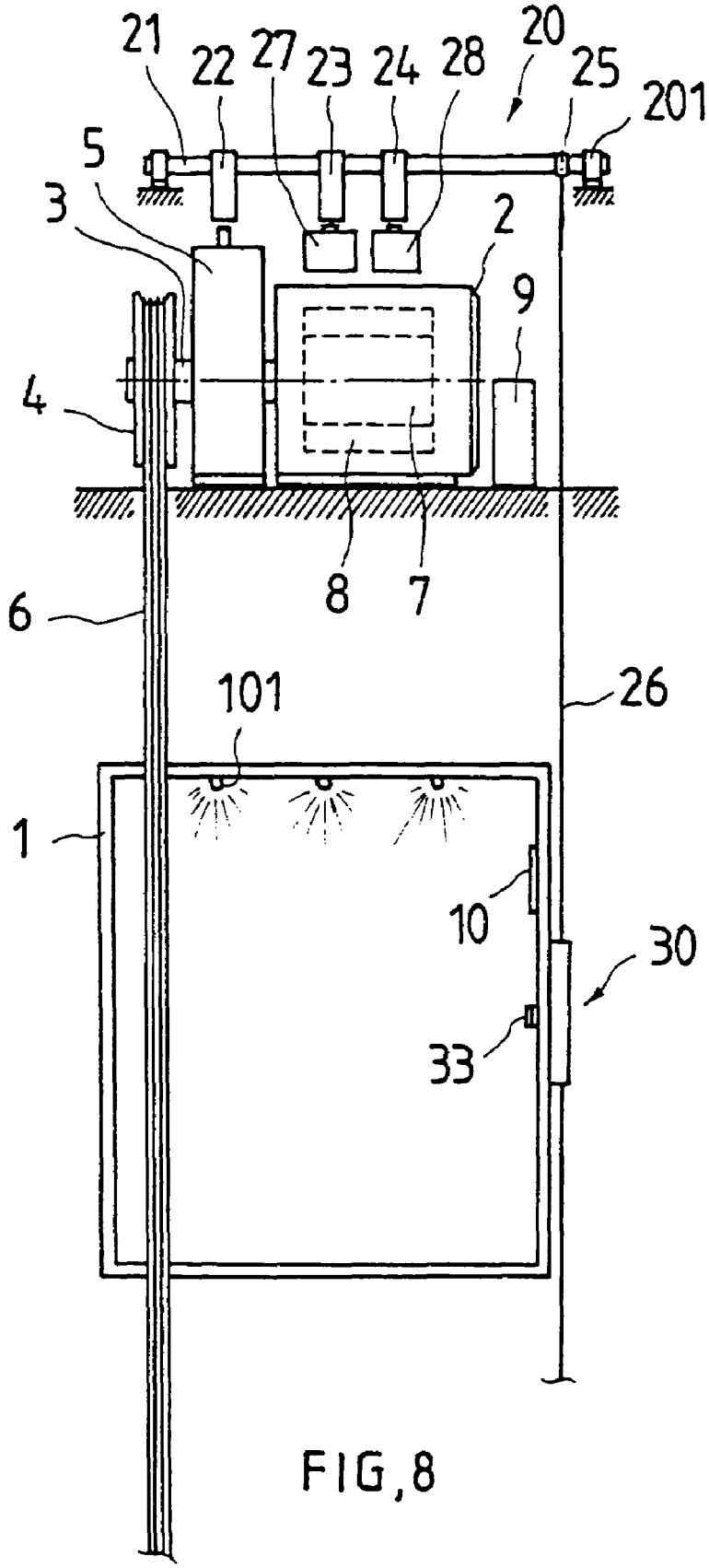
FIG,8

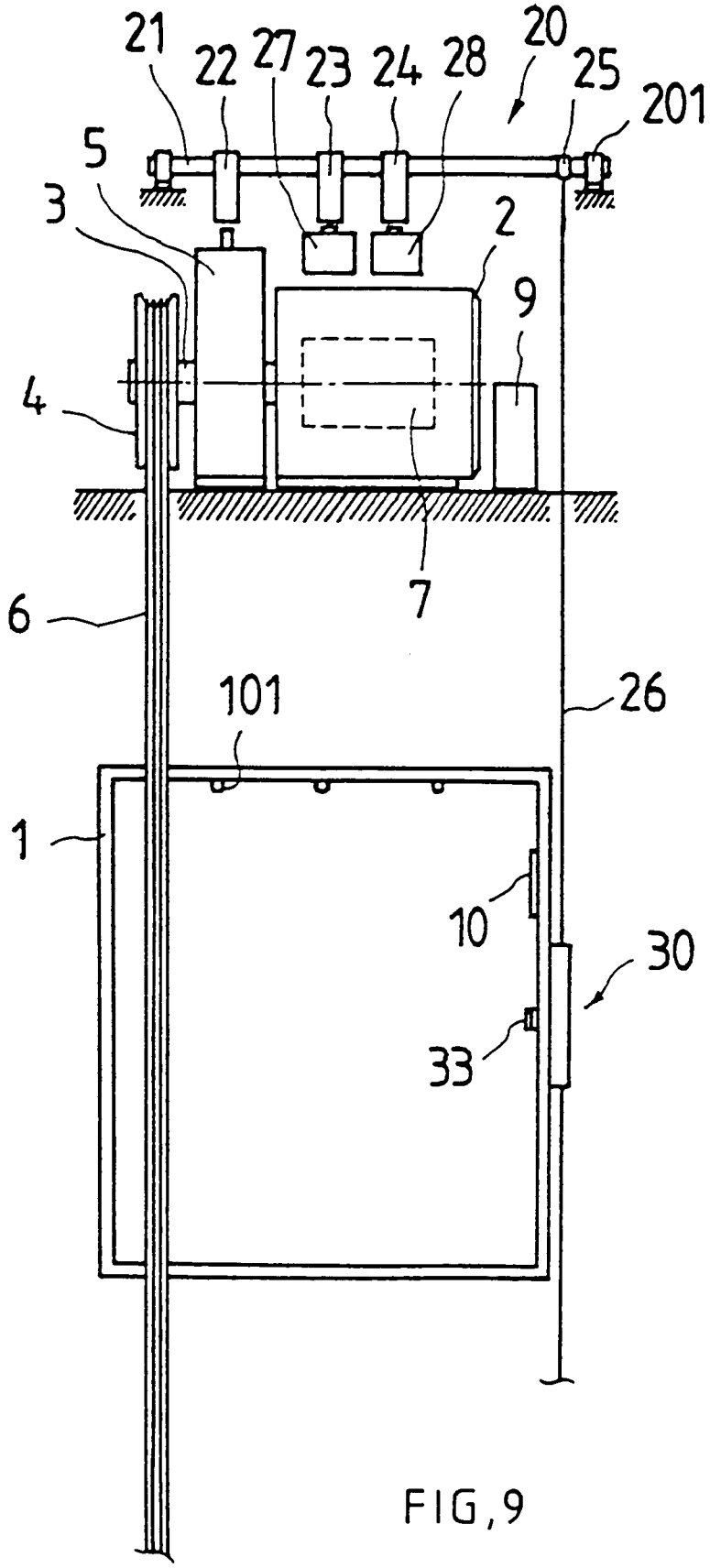
FIG,9

ELEVATOR ESCAPE DEVICE

BACKGROUND OF THE INVENTION

1. Field of Invention

The present invention relates to escape devices of elevator and more particularly to an improved manual device adapted to open the door of an elevator in case of emergency.

2. Related Art

Conventionally, both a backup power supply (e.g., generator) and a normal motor are provided in an elevator such that the backup generator is able to supply power to the motor for maintaining its normal operation in case of power outage. However, the backup generator is useless if the motor is also malfunctioned, i.e., person(s) still trapped in the car. Moreover, typically a manual escape device is provided in the car such that a person trapped in the car may operate the escape device to escape. However, it is often that the car may open at a position between two adjacent floors by operating the escape device in case of both power outage and the malfunctioned motor. This also cannot help person(s) trapped in the car escape safely. Thus, it is desirable to provide a novel elevator escape device in order to overcome the inadequacies of the prior art and contribute significantly to the advancement of the art.

SUMMARY OF THE INVENTION

It is therefore an object of the present invention to provide an escape device of an elevator including a car, a motor including normal coils and backup coils, a backup power supply for activating the backup coils by closing a switch in the car, a sheave driven by the motor, hoist ropes run in a grooved rim of the sheave, the hoist ropes having one end connected to the car, a counterweight connected to the other end of the hoist ropes, and a brake, comprising a slow movement assembly comprising a rotatable shaft, a plurality of detents of cam section on the shaft, a bar on the shaft, first and second ropes each having one end fixed at either end of the bar, and a plurality of electromagnetic contacts; a control assembly on a wall of the car and connected to the first rope, the control assembly comprising a hollow, rectangular member with the first rope passed through, a backup electromagnetic contact for pivoting the member, a handle for pivoting the member, the handle including a series of parallel projections at its end proximate the member and a spring loaded detent urged against one of the projections, a link having one end connected to the member, a sliding connecting rod having one end loosely connected to the other end of the link, a guide sleeve put on the connecting rod, and a roller disposed externally of the car and connected to the other end of the connecting rod; and a return assembly on a wall of a vertical opening for the elevator and comprising a plurality of raised plates disposed laterally for guiding the roller;

It is another object of the present invention to provide an escape device of an elevator including a car, a motor, a backup power supply for activating the motor by closing a switch in the car, a sheave driven by the motor, hoist ropes run in a grooved rim of the sheave, the hoist ropes having one end connected to the car, a counterweight connected to the other end of the hoist ropes, and a brake, comprising a slow movement assembly comprising a rotatable shaft, a plurality of detents of cam section on the shaft, a bar on the shaft, first and second ropes each having one end fixed at either end of the bar, and a plurality of electromagnetic contacts; a control assembly on a wall of the car and connected to the first rope, the control assembly comprising a hollow, rectangular member with the first rope passed through, a backup electromagnetic contact for pivoting the member, a handle for pivoting the member, the handle including a series of parallel projections at its end proximate the member and a spring loaded detent urged against one of the projections, a link having one end connected to the member, a sliding connecting rod having one end loosely connected to the other end of the link, a guide sleeve put on the connecting rod, and a roller disposed externally of the car and connected to the other end of the connecting rod; and a return assembly on a wall of a vertical opening for the elevator and comprising a plurality of raised plates disposed laterally for guiding the roller; wherein in response to a stop of the elevator in case of power outage, a person trapped in the car is able to press the switch to activate the backup generator and the motor, either: (i) the backup electromagnetic contact is enabled to activate the slow movement assembly and cause a first one of the detents to contact and disable the brake for rotating the drive shaft if the backup generator functions normally, the car is adapted to lower due to different heights of the counterweight and the car or (ii) the person trapped in the car manipulates the handle to activate the slow movement assembly if the backup generator malfunctions, the brake is disabled by contacting a first one of the detents for rotating the drive shaft to lower the car, the return assembly operates to return the slow movement assembly to its nonoperating position via the control assembly wherein the electromagnetic contacts are short-circuited sequentially by causing each of the remaining ones of the detents to contact a corresponding one of the electromagnetic contacts with a predetermined phase difference therebetween, the car slowly arrives at a nearest correct floor, and the trapped person is able to open a door to escape.

In one aspect of the present invention, the car comprises a plurality of LED lamps on its roof, the LED lamps electrically connected to the electromagnetic contacts.

In another aspect of the present invention, the first rope is tightened in response to the pivoted member by pivoting the handle, and the bar pivots to pivot the shaft and the detents for disabling the brake and enabling the electromagnetic contacts sequentially.

The above and other objects, features and advantages of the present invention will become apparent from the following detailed description taken with the accompanying drawings.

BRIEF DESCRIPTION OF THE DRAWINGS

FIG. 1 is a schematic side drawing of a first preferred embodiment of escape device mounted above an elevator according to the invention and other associated major elevator components;

FIG. 2 is a schematic side drawing of the car stopped in a correct floor and associated components thereof;

FIG. 3 is a view similar to FIG. 2 showing the car being operated in a slow lowering mode;

FIG. 4 schematically depicts relative positions between a first detent and a brake, between a second detent and a first electromagnetic contact, and between a third detent and a second electromagnetic contact;

FIG. 5 schematically depicts a coupling of the pulley-like member and the handle;

FIG. 6 is a sectional view of the handle;

FIG. 7 is a flowchart depicting a process for operating escape device according to the invention;

FIG. 8 is a schematic side drawing of a second preferred embodiment of escape device mounted above an elevator according to the invention and other associated major elevator components; and FIG. 9 is a schematic side drawing of a third preferred embodiment of escape device mounted above an elevator according to the invention and other associated major elevator components.

DETAILED DESCRIPTION OF THE INVENTION

Referring to FIGS. 1 to 6, there is shown an escape device of elevator constructed in accordance with a first preferred embodiment of the invention. The components of the first preferred embodiment comprise a motor 2 having a drive shaft 3, a sheave 4 provided at an outer end of the drive shaft 3, hoist ropes 6 run in a grooved rim of the sheave 4, the ropes 6 having one end connected to a car 1 and the other end connected to a counterweight (not shown), and a brake 5 provided proximate the drive shaft 3 between the sheave 4 and the motor 2. The motor 2 is adapted to enable the drive shaft 3 to rotate clockwise (e.g., hoisting of the car 1) or counterclockwise (e.g., lowering of the car 1).

The motor 2 comprises normal coils 7 and backup coils 8 which are powered by a backup power supply (e.g., generator) 9. The backup generator 9 is activated by pressing a switch 10 in the car 1. The backup coils 8 function only in case of power outage and after activating the backup generator 9 for maintaining a normal operation of the motor 2.

In the same room of the motor 2 and other components described above, there is provided a slow movement assembly 20. The slow movement assembly 20 comprises a shaft 21 at both ends rotatably fastened by two seats 201, first, second, and third detents 22, 23, and 24 of cam section fixedly formed on the shaft 21 and corotated therewith, a bar 25 fixedly formed on the shaft 21, first and second ropes 26 and 26' each having one end fixed at either end of the bar 25, and a backup electromagnetic contact 261 at the second rope 26'. The first rope 26 is extended to connect to a control assembly 30 on a wall of the car 1. The control assembly 30 is adapted to pull the first rope 26 for rotating the bar 25 and thus the shaft 21 and the detents 22, 23, and 24. The first detent 22 urges against the brake 5 to release it. As a result, the drive shaft 3 of the motor 2 rotates to cause the sheave 4 to rotate the same. Both the second and third detents 23 and 24 contact first and second electromagnetic contacts 27 and 28 thereunder with a phase difference therebetween (i.e., the first detent 23 contacts the first electromagnetic contact 27 and the second detent 24 contacts the second electromagnetic contact 28 later) for short-circuiting the same (i.e., close the circuit) respectively. Each of the first and second electromagnetic contacts 27 and 28 has a variable resistor (not shown) such that each of the first and second electromagnetic contacts 27 and 28 is able to operate normally in a high temperature environment caused heat generated by the rotating motor 2 by adjusting its resistor. Moreover, the short-circuited first and second electromagnetic contacts 27 and 28 are adapted to stepwise adjust (i.e., decrease) the rotating speed of the drive shaft 3. As an end, the car 1 is able to lower slowly due to different heights of the counterweight and the car 1.

The control assembly 30 comprises a hollow, rectangular pulley-like member 31 with the first rope 26 passed through, a third electromagnetic contact 32 for pivoting the pulley-like member 31, and a handle 33 also for pivoting the pulley-like member 31. The first rope 26 is tightened by the pivoted pulley-like member 31 by pivoting the handle 33. And in turn, as described above the bar 25 pivots and thus the shaft 21 and the detents 22, 23, and 24 pivot. Next, the brake 5 is released (i.e., the drive shaft 3 is free) and the first and second electromagnetic contacts 27 and 28 are enabled sequentially (i.e., with a phase difference therebetween). As an end, the car 1 is able to lower slowly. The control assembly 30 further comprises a link 34 extended from an upper side of the pulley-like member 31, the link 34 having its other end loosely connected to a connecting rod 35. The connecting rod 35 passes a guide sleeve 36 to extend beyond the car 1 for connecting to a roller 37. The roller 37 is proximate the outer wall of the car 1. A return assembly 40 is adapted to force the pulley-like member 31 to return to its nonoperating position. As a result, the first rope 26 is loosened again. And in turn, the bar 25, the shaft 21, and the detents 22, 23, and 24 return to their nonoperating positions, the electromagnetic contacts 27 and 28 are disabled (i.e., open-circuit), and the brake 5 is pressed (i.e., the drive shaft 3 is stopped). As an end, the car 1 stops at a correct floor.

The return assembly 40 comprises a raised large plate 41 formed on a wall of shaft, and a raised small plate 42 formed thereon. Both the plates 41 and 42 are disposed vertically. The plate 41 has two inclined surfaces 43 proximate its both ends, and the plate 42 also has two inclined surfaces 44 at its both ends. The inclined surfaces 43 and 44 are adapted to guide the roller 37 so as to stepwise push the connecting rod 35 and thus the pulley-like member 31 back to their nonoperating positions. The number of steps is equal to the number of plates 41 and 42. Also, the handle 33 has a series of parallel projections 331 at its end proximate the pulley-like member 31 and a spring loaded detent 332 urged against one of the projections 331 in which the number of the projections 331 is equal to a sum of one and that of the steps (e.g., three projections 331 as shown). By configuring as above, the handle 33 is adapted to stepwise operate. In addition, the number of detents 23 and 24 is equal to that of the number of the plates 41 and 42 so as to slowly lower the car 1 in a lowering process. This configuration aims at preventing strong shock from occurring when the car 1 is lowering.

Referring to FIG. 7, a flowchart depicting a process for operating the escape device according to the invention is illustrated. In a case of power outage occurred, person(s) trapped in the car 1 may press the switch 10 to cause the motor 2 to switch to its backup coils 8 and activate the backup generator 9 at the same time. The third electromagnetic contact 32 is thus enabled to activate the slow movement assembly 20 and release the brake 5 (i.e., the drive shaft 3 is free) if the backup generator 9 functions normally. The car 1 is able to automatically lower due to different heights of the counterweight and the car 1. The return assembly 40 also operates to manipulate the slow movement assembly 20 (i.e., return the slow movement assembly 20 to its nonoperating position) via the control assembly 30 in which the electromagnetic contacts 27 and 28 are short-circuited sequentially. As an end, the car 1 slowly arrives at a correct floor (e.g., nearest floor) and the trapped persons can open the elevator door to escape safely. Alternatively, person(s) trapped in the car 1 may manipulate the handle 33 to manually activate the slow movement assembly 20 if the backup generator 9 malfunctions. The brake 5 is released (i.e., the drive shaft 3 is free) to allow the car 1 to lower. The return assembly 40 also operates to manipulate the slow movement assembly 20 (i.e., return the slow movement assembly 20 to its nonoperating position) via the control assembly 30 in which the electromagnetic contacts 27 and 28 are short-circuited sequentially. As an end, the car 1 slowly arrives at a correct floor (e.g., nearest floor) and the trapped persons can open the elevator door to escape safely.

Referring to FIG. 8, a second preferred embodiment of elevator escape device according to the invention is shown. The second preferred embodiment substantially has same structure as the first preferred embodiment. The difference between the first and the second preferred embodiments, i.e., the characteristic of the second preferred embodiment is detailed below. A plurality of LED (light-emitting diode) lamps 101 are provided on roof of the car 1. The LED lamps 101 are powered by the electromagnetic contacts 27 and 28. The provision of the LED lamps 101 aims at providing limited lighting to person(s) trapped in the car 1 in case of power outage or malfunction so as to decrease scare.

Referring to FIG. 9, a third preferred embodiment of elevator escape device according to the invention is shown. The third preferred embodiment substantially has same structure as the first preferred embodiment. The difference between the first and the third preferred embodiments, i.e., the characteristic of the third preferred embodiment is detailed below. The backup coils 8 are eliminated. The motor 2 is electrically connected to the backup generator 9 and the electromagnetic contacts 27 and 28 in case of power outage. Thus, in case of power outage person(s) trapped in the car 1 may press the switch 10 to cause the coils 7 to activate the backup generator 9. Similarly, the third electromagnetic contact 32 is thus enabled to activate the slow movement assembly 20 and release the brake 5 (i.e., the drive shaft 3 is free) if the backup generator 9 functions normally. The car 1 is able to automatically lower due to different heights of the counterweight and the car 1. The return assembly 40 also operates to manipulate the slow movement assembly 20 (i.e., return the slow movement assembly 20 to its nonoperating position) via the control assembly 30 in which the electromagnetic contacts 27 and 28 are short-circuited sequentially. As an end, the car 1 slowly arrives at a correct floor (e.g., nearest floor) and the trapped persons can open the elevator door to escape safely. Alternatively, person(s) trapped in the car 1 may manipulate the handle 33 to manually activate the slow movement assembly 20 for escape if the backup generator 9 malfunctions. This embodiment is applicable to existing elevator in which only a minimum modification thereof is required.

While the invention herein disclosed has been described by means of specific embodiments, numerous modifications and variations could be made thereto by those skilled in the art without departing from the scope and spirit of the invention set forth in the claims.

What is claimed is:

1. An escape device of an elevator including a car, a motor including normal coils and backup coils, a backup power supply for activating the backup coils by closing a switch in the car, a sheave driven by the motor, hoist ropes run in a grooved rim of the sheave, the hoist ropes having one end connected to the car, a counterweight connected to the other end of the hoist ropes, and a brake, comprising:

a slow movement assembly comprising a rotatable shaft, a plurality of detents of cam section on the shaft, a bar on the shaft, first and second ropes each having one end fixed at either end of the bar, and a plurality of electromagnetic contacts;

a control assembly on a wall of the car and connected to the first rope, the control assembly comprising a hollow, rectangular member with the first rope passed through, a backup electromagnetic contact for pivoting the member, a handle for pivoting the member, the handle including a series of parallel projections at its end proximate the member and a spring loaded detent urged against one of the projections, a link having one end connected to the member, a sliding connecting rod having one end loosely connected to the other end of the link, a guide sleeve put on the connecting rod, and a roller disposed externally of the car and connected to the other end of the connecting rod; and a return assembly on a wall of a vertical opening for the elevator and comprising a plurality of raised plates disposed laterally for guiding the roller;

wherein in response to a stop of the elevator in case of power outage, a person trapped in the car is able to press the switch to cause the motor to switch to the backup coils and activate the backup generator at the same time, either:

(i) the backup electromagnetic contact is enabled to activate the slow movement assembly and cause a first one of the detents to contact and disable the brake for rotating the drive shaft if the backup generator functions normally, the car is adapted to lower due to different heights of the counterweight and the car or (ii) the person trapped in the car manipulates the handle to activate the slow movement assembly if the backup generator malfunctions, the brake is disabled by contacting a first one of the detents for rotating the drive shaft to lower the car, the return assembly operates to return the slow movement assembly to its nonoperating position via the control assembly wherein the electromagnetic contacts are short-circuited sequentially by causing each of the remaining ones of the detents to contact a corresponding one of the electromagnetic contacts with a predetermined phase difference therebetween, the car slowly arrives at a nearest correct floor, and the trapped person is able to open a door to escape.

2. The escape device of claim 1, wherein the car comprises a plurality of LED lamps on its roof, the LED lamps electrically connected to the electromagnetic contacts.

3. The escape device of claim 1, wherein the first rope is tightened in response to the pivoted member by pivoting the handle, and the bar pivots to pivot the shaft and the detents for disabling the brake and enabling the electromagnetic contacts sequentially.

4. An escape device of an elevator including a car, a motor, a backup power supply for activating the motor by closing a switch in the car, a sheave driven by the motor, hoist ropes run in a grooved rim of the sheave, the hoist ropes having one end connected to the car, a counterweight connected to the other end of the hoist ropes, and a brake, comprising:

a slow movement assembly comprising a rotatable shaft, a plurality of detents of cam section on the shaft, a bar on the shaft, first and second ropes each having one end fixed at either end of the bar, and a plurality of electromagnetic contacts;

a control assembly on a wall of the car and connected to the first rope, the control assembly comprising a hollow, rectangular member with the first rope passed through, a backup electromagnetic contact for pivoting the member, a handle for pivoting the member, the handle including a series of parallel projections at its end proximate the member and a spring loaded detent urged against one of the projections, a link having one end connected to the member, a sliding connecting rod having one end loosely connected to the other end of the link, a guide sleeve put on the connecting rod, and a roller disposed externally of the car and connected to the other end of the connecting rod; and a return assembly on a wall of a vertical opening for the elevator and comprising a plurality of raised plates disposed laterally for guiding the roller;

wherein in response to a stop of the elevator in case of power outage, a person trapped in the car is able to press the switch to activate the backup generator and the motor, either:

(i) the backup electromagnetic contact is enabled to activate the slow movement assembly and cause a first one of the detents to contact and disable the brake for rotating the drive shaft if the backup generator functions normally, the car is adapted to lower due to different heights of the counterweight and the car or (ii) the person trapped in the car manipulates the handle to activate the slow movement assembly if the backup generator malfunctions, the brake is disabled by contacting a first one of the detents for rotating the drive shaft to lower the car, the return assembly operates to return the slow movement assembly to its nonoperating position via the control assembly wherein the electromagnetic contacts are short-circuited sequentially by causing each of the remaining ones of the detents to contact a corresponding one of the electromagnetic contacts with a predetermined phase difference therebetween, the car slowly arrives at a nearest correct floor, and the trapped person is able to open a door to escape.

5. The escape device of claim 4, wherein the car comprises a plurality of LED lamps on its roof, the LED lamps electrically connected to the electromagnetic contacts.

6. The escape device of claim 4, wherein the first rope is tightened in response to the pivoted member by pivoting the handle, and the bar pivots to pivot the shaft and the detents for disabling the brake and enabling the electromagnetic contacts sequentially.

* * * * *